US009164461B2

(12) United States Patent
Taira

(10) Patent No.: US 9,164,461 B2
(45) Date of Patent: Oct. 20, 2015

(54) IMAGE FORMING APPARATUS

(71) Applicant: Kazuya Taira, Nagoya (JP)

(72) Inventor: Kazuya Taira, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/193,005

(22) Filed: Feb. 28, 2014

(65) Prior Publication Data

US 2014/0286686 A1 Sep. 25, 2014

(30) Foreign Application Priority Data

Mar. 25, 2013 (JP) ..... 2013-062400

(51) Int. Cl.
*G03G 15/00* (2006.01)
*B65H 5/02* (2006.01)

(52) U.S. Cl.
CPC ..... *G03G 15/6529* (2013.01); *B65H 5/021* (2013.01); *B65H 2402/521* (2013.01); *B65H 2404/252* (2013.01); *B65H 2404/255* (2013.01); *B65H 2404/2532* (2013.01)

(58) Field of Classification Search
CPC ..... B65H 5/021
USPC ..... 399/395
See application file for complete search history.

(56) References Cited

U.S. PATENT DOCUMENTS 5,467,171 A * 11/1995 Castelli et al. ..... 399/162
6,397,033 B1 * 5/2002 Todome ..... 399/303
6,457,709 B1 * 10/2002 Madsen et al. ..... 271/275
2005/0090932 A1 * 4/2005 Belmann et al. ..... 700/230
2006/0119029 A1 * 6/2006 Kitamura ..... 271/275
2006/0233578 A1 * 10/2006 Maki et al. ..... 399/388
2007/0052159 A1 * 3/2007 Wingate et al. ..... 271/198
2009/0087231 A1 4/2009 Masaki et al.
2011/0049795 A1 * 3/2011 Yamaguchi ..... 271/264
2012/0070201 A1 3/2012 Shiobara

FOREIGN PATENT DOCUMENTS

JP 2000-198567 A 7/2000
JP 2003-215943 A 7/2003
JP 2005-326532 A 11/2005
JP 2009-086463 A 4/2009
JP 2011-053460 A 3/2011
JP 2012-063655 A 3/2012

OTHER PUBLICATIONS

Aug. 25, 2015—(JP) Notification of Reasons for Rejection—App 2013-062400.

* cited by examiner

*Primary Examiner* — Anthony Nguyen
(74) *Attorney, Agent, or Firm* — Banner & Witcoff, Ltd.

(57) ABSTRACT

An image forming apparatus including an endless belt; a driving roller to move the endless belt in circulation; a driven roller to rotate along with circulation of the endless belt; a first bearing arranged on a first-side end of the driven roller along an axial direction to movable and to support the driven roller rotatably; a resilient member to apply a resilient force to the driven roller; and a frame having a first guide to the first bearing to move in an inclined direction, which inclines with respect to a virtual line extending through a rotation axis of the driving roller and the rotation axis of the driven roller, is provided. The first guide is formed to incline with respect to the virtual line to be closer to a virtual plane containing the strained plane of the endless belt as the first guide extends farther from the driving roller.

9 Claims, 5 Drawing Sheets

IMAGE FORMING APPARATUS

CROSS REFERENCE TO RELATED APPLICATION

This application claims priority from Japanese Patent Application No. 2013-062400, filed on Mar. 25, 2013, the entire subject matter of which is incorporated herein by reference.

BACKGROUND

1. Technical Field

An aspect of the present invention relates to an image forming apparatus having an endless belt, which includes an intermediate transfer belt and a conveyer belt.

2. Related Art

An image forming unit having an endless belt configured to circulate endlessly is known. When intensity of tensile forces in the endless belt are different between widthwise edges thereof, the endless belt may undesirably skew. In particular, the endless belt may skew toward one of the edges, in which the tensile force is smaller, rather than the other one of the edges, in which the tensile force is greater. Therefore, it may be preferable to restrain the belt from being skewed in consideration of the difference in tensile forces.

The skew in this context refers to a behavior of the endless belt moving along a widthwise direction, which is an axial direction of rollers, while the endless belt circulates endlessly around the rollers. Therefore, when the endless belt skews largely along the axial direction of the rollers, the endless belt may run off from the rollers.

SUMMARY

Further, the endless belt may skew when circumferential lengths of the endless belt are different between the widthwise edges thereof. Namely, when a position of one of the rollers such as a driven roller is relatively movable and a position of another one of the rollers such as a driving roller is relatively fixed with respect to a frame to hold the rollers, and if the circumferential lengths of the widthwise edges of the endless belt are different, the driven roller may incline with respect to the driving roller. For example, when a circumferential length at a first edge being one of the widthwise edges of the endless belt is shorter than a circumferential length at a second edge being the other one of the widthwise edges, the endless belt may skew in a direction toward the widthwise edge of the shorter circumferential length, i.e., in a direction from the second edge toward the first edge.

Furthermore, the endless belt may skew in other reasons even when the circumferential lengths of the widthwise edges of the endless belt are the same. For example, the endless bent may skew when one of a plurality of rollers extending along the width of the endless belt is inclined with respect to another one of the rollers, or when diameters of at least one of the rollers vary along the axial direction.

The present invention is advantageous in that an image forming apparatus, in which an endless belt is restricted from skewing, is provided.

According to an aspect of the present invention, an image forming apparatus configured to form an image on a sheet, including a piece of endless belt; a driving roller, around which the endless belt is strained, the driving roller being configured to move the endless belt in circulation; a driven roller, around which the endless belt is strained, the driven roller being configured to rotate along with the circulation of the endless belt; a first bearing arranged on a first-side end of the driven roller along an axial direction, the axial direction corresponding to a rotation axis of the driven roller, and configured to support the driven roller rotatably, the first bearing being configured to be movable while supporting the driven roller rotatably; a resilient member configured to apply a resilient force, which tends to separate the driven roller apart from the driving roller, to the driven roller; and a frame comprising a first guide, the first guide being configured to guide the first bearing to move in an inclined direction, which inclines with respect to a virtual line extending through a rotation axis of the driving roller and the rotation axis of the driven roller, is provided. When a moving direction to move from the rotation axis of the driving roller toward the rotation axis of the driven roller is defined as a forward direction, and when a part of the endless belt moving in the forward direction forms a strained plane, the first guide is formed to incline with respect to the virtual line to be closer to a virtual plane containing the strained plane as the first guide extends farther from the driving roller.

BRIEF DESCRIPTION OF THE ACCOMPANYING DRAWINGS

Figure 5:
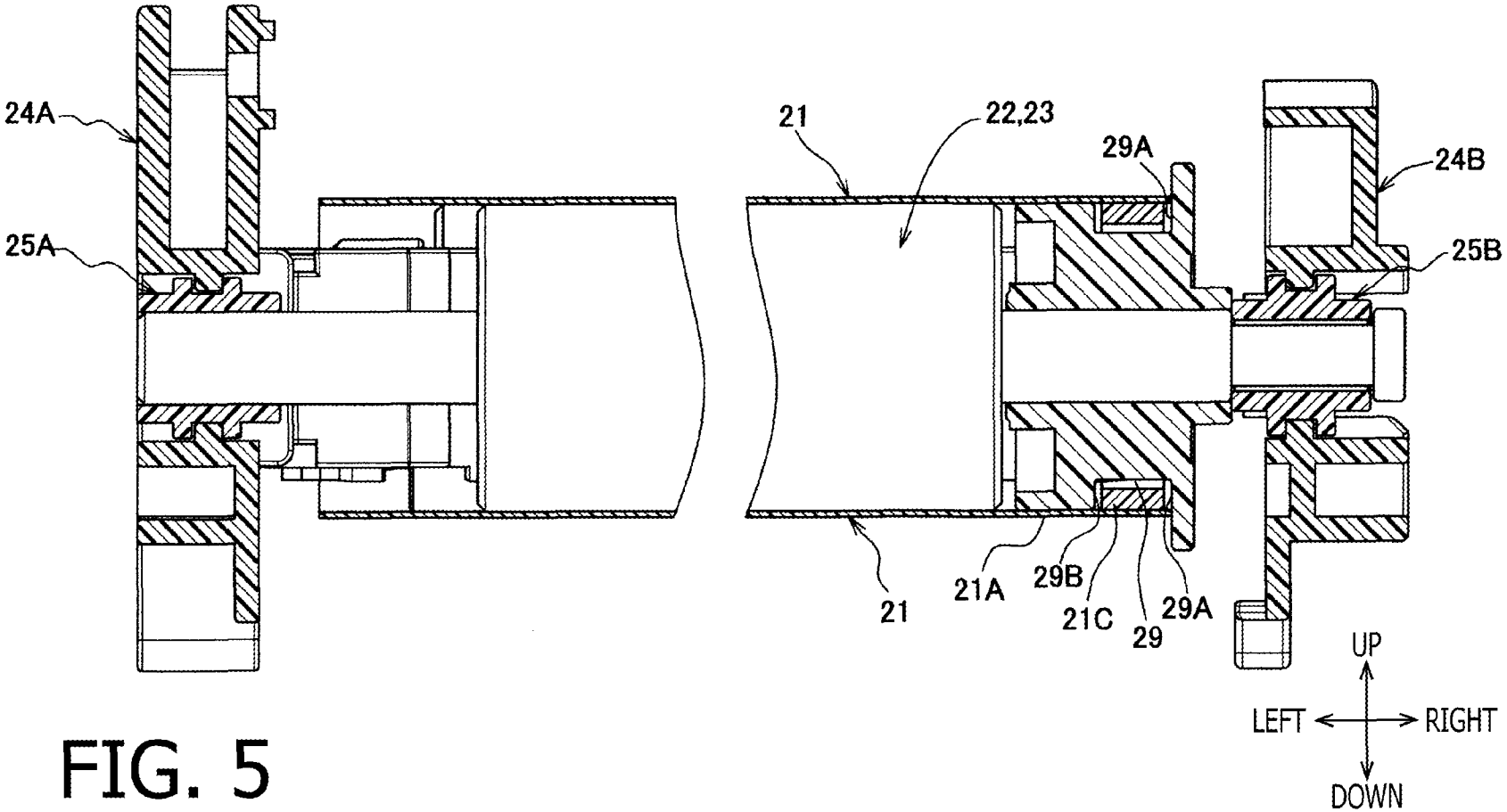

FIG. 5 is a cross-sectional view of the belt unit 20 showing structures of a driving roller 22, a driven roller 23, and a guide rib 21 in the image forming apparatus 1 according to the embodiment of the present invention.

DETAILED DESCRIPTION

Hereinafter, an electro-photographic image forming apparatus 1 as an embodiment of the present invention will be described with reference to the accompanying drawings. It is noted that various connections are set forth between elements in the following description. These connections in general, and unless specified otherwise, may be direct or indirect, and this specification is not intended to be limiting in this respect.

In the embodiment described below, directions concerning the image forming apparatus 1 and each part included in the image forming apparatus 1 will be referred to based on orientations indicated by arrows shown in each drawing. In this regard, a right-to-left or left-to-right direction of the image forming apparatus 1 may also be referred to as a right-left direction or a widthwise direction. An up-to-down or down-to-up direction corresponds to a vertical direction of the image forming apparatus 1. The front-to-rear or rear-to-front direction may be referred to as a front-rear direction or a direction of depth. However, the orientations concerning the image forming apparatus 1 may not necessarily be limited to those described below or indicated in the accompanying drawings. Further, it is noted that a quantity of each of the components and elements denoted by reference signs is, unless otherwise noted, at least one.

1. Overall Configuration of Image Forming Apparatus

An overall configuration of the image forming apparatus 1 will be described with reference to FIG. 1. The image forming apparatus 1 has a chassis 3. The chassis 3 contains an image forming unit 5, which is configured to form an image on a sheet in an electro-photographic method. The image forming unit 5 includes a plurality of developer cartridges 7, a plurality of photosensitive drums 8, a plurality of chargers 8A, an exposure unit 9, and a fixing unit 11.

Each of the developer cartridges 7 includes a developer roller 7A and a developer container 7B. Rotation axes of the developer rollers 7A extend in parallel with one another. The developer cartridges 7 are arranged to align along a direction orthogonal to the rotation axes thereof.

Quantities of the photosensitive drums 8 and the chargers 8A correspond to a quantity of the developer cartridges 7. The photosensitive drums 8 are configured to carry images formed in a developer agent on circumferential surfaces thereof. The chargers 8A are configured to electrically charge the photosensitive drums 8. The exposure unit 9 is configured to emit beams to the photosensitive drums 8 and form latent images on the circumferential surfaces of the photosensitive drums 8. The developer rollers 7A are configured to supply the developer agent stored in the containers 7A to the photosensitive drums 8 and form images developed from the latent images on the circumferential surfaces of the photosensitive drums 8.

The developer cartridges 7 are detachably attached to a drawer 10. The drawer 10 is movable with respect to a body of the image forming apparatus 1. The body of the image forming apparatus 1 refers to parts and components, such as a main frame (not shown), which are not removable or exchangeable to a user. When the drawer 10 is drawn frontward from the body of the image forming apparatus 1, the developer cartridges 7 are removable from the body of the image forming apparatus 1 and from the drawer 10.

The image forming apparatus 1 includes a belt 21, which is a piece of endless belt strained around a driving roller 22 and a driven roller 23. An upper outer surface of the belt 21 facing the photosensitive drums 8 forms a transferable plane 21B and conveys the sheet toward the fixing unit 11 as the belt 21 moves in a direction from one side, on which the driving roller 23 is disposed, to the other side, on which the driving roller 22 is disposed.

The image forming apparatus 1 includes a belt unit 1, which includes the belt 21, the driving roller 22, and the driven roller 23. The belt unit 20 is detachably attached to the body of the image forming apparatus 1. Therefore, the belt 21, the driving roller 22, and the driven roller 23 are integrally detached from and attached to the body of the image forming apparatus 1. The belt unit 20 will be described later in detail.

Transfer members 13 are arranged in positions opposite from the photosensitive drums 8 across the transferable plane 21B of the belt 21. The transfer members 13 serve in cooperation with the belt 21 and the photosensitive drums 8 to transfer the images, which are formed in the developer agent and carried on the photosensitive drums 8, onto the sheet arranged on the transfer surface 12B of the belt 21. Thus, the images formed in the developer agent on the photosensitive drums 8 are layered one over another on the sheet. The fixing unit 11 is configured to heat the sheet and thermally fix the layered images thereat.

2. Belt Unit

Figure 2:
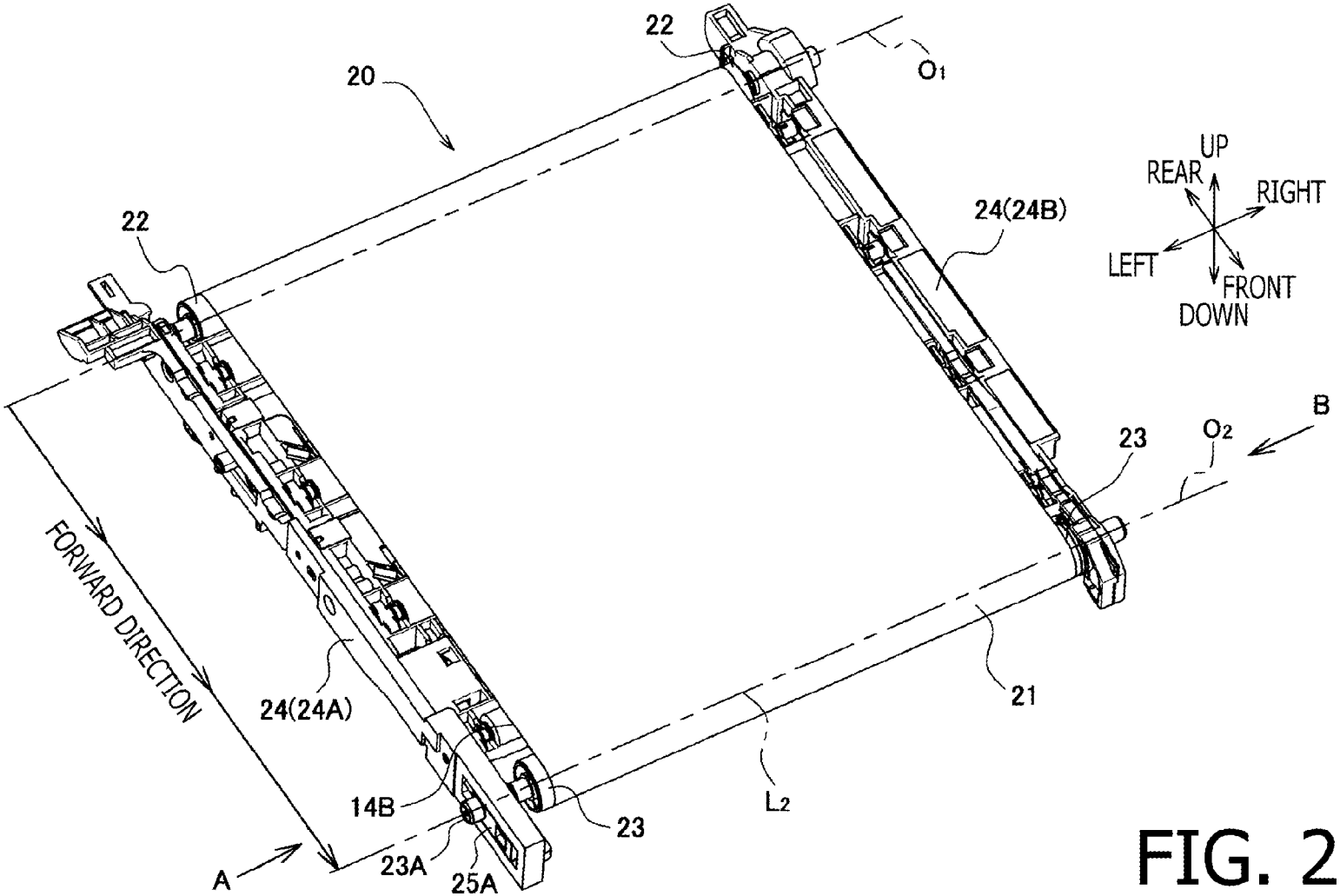
FIG. 2 is a perspective view of a belt unit 20 of the image forming apparatus 1 according to the embodiment of the present invention.

The belt unit 20 includes, as shown in FIG. 2, the belt 21, the driving roller 22, the driven roller 23, and a frame 24. The frame 24 supports the driving roller 22 and the driven roller 23 at axial ends thereof.

The frame 24 includes a first frame 24A, which is shown on a left-hand side in FIG. 2, and a second frame 24B, which is shown on a right-hand side in FIG. 2. In other words, the first frame 24A and the second frame 24B form the frame 24. The first frame 24A and the second frame 24B are arranged to extend longitudinally in parallel with each other along the front-rear direction.

The belt 21 is an endless belt made of a resin such as thermoplastic elastomer and is arranged in a strained condition to roll around the driving roller 22 and the driven roller 23. In the following description, a moving direction of the endless belt 21, directed from a rotation axis O1 of the driving roller 22 toward a rotation axis O2 of the driven roller 23, will be defined as a forward direction, and a plane part of the belt 21 moving in the forward direction will be defined as a strained plane 21A.

Figure 1:
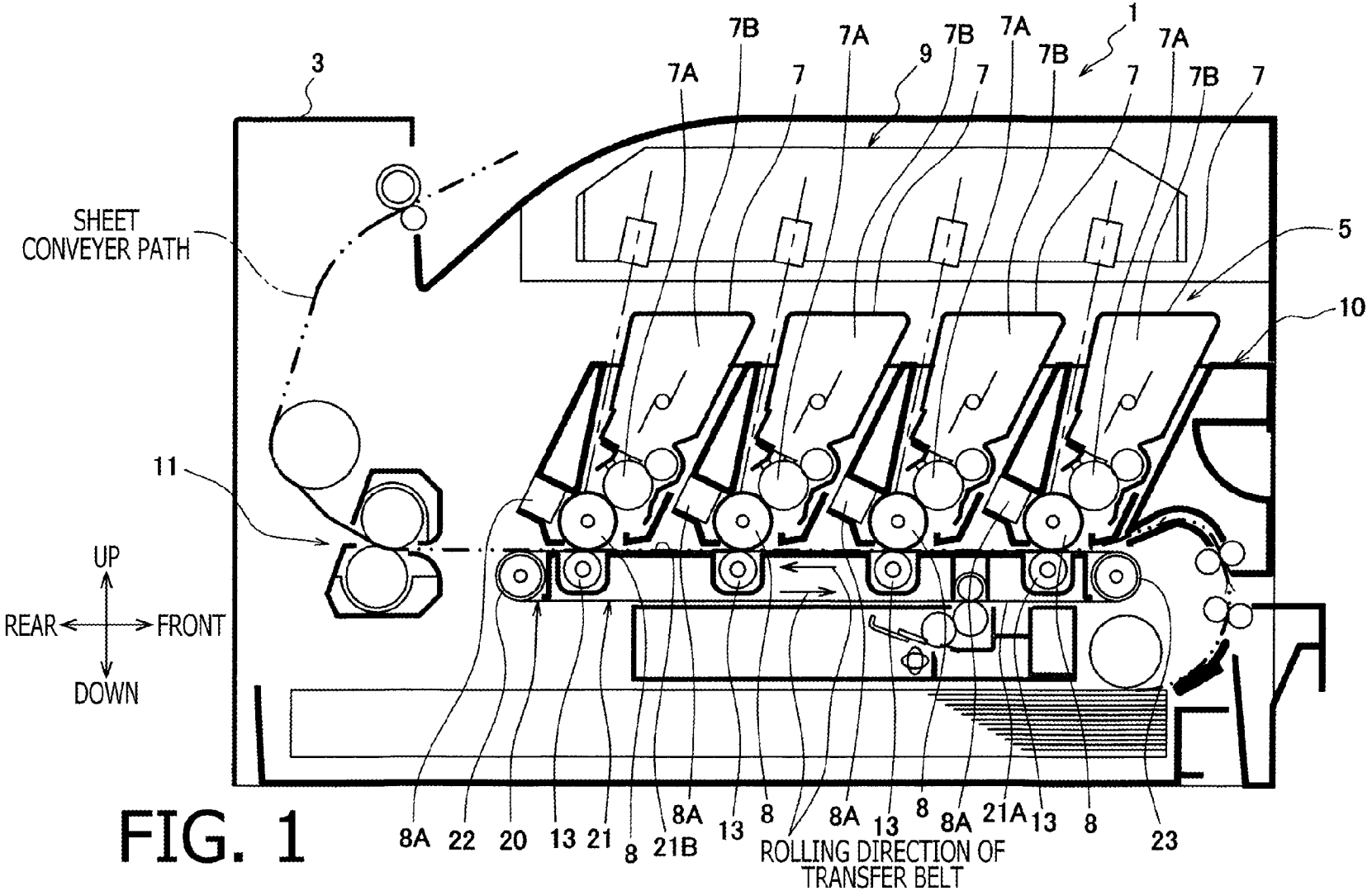
FIG. 1 is a cross-sectional side view of an image forming apparatus 1 according to an embodiment of the present invention.

Therefore, as shown in FIG. 1, the strained plane 21A comes on an opposite side from the transferable plane 21B across the driving roller 23 and the driven roller 23. In other words, the strained plane 21A is arranged in a lower position in the belt unit 20. Meanwhile, the transferable plane 21B is arranged in an upper position in the belt unit 20.

The driving roller 22 is rotatably attached to the frame 24, but a relative position thereof with respect to the frame 24 is fixed. In other words, the driving roller 22 is relatively immovable with respect to the frame 24. The driving roller 22 is rotated by driving force supplied from a driving source, such as an electrical motor (not shown) provided in the body of the image forming apparatus 1, and drives the belt 21 to circulate.

The driven roller 23 is rotatably attached to the frame 24, and a relative position thereof with respect to the frame 24 is changeable. In other words, the driven roller 23 is relatively movable with respect to the frame 24. As the driving roller 22 rotates and the belt 21 is circulated, the driven roller 23 is rotated along with the circulation of the belt 21.

In FIG. 2, an axis L2 indicates the rotation axis of the driven roller 23. Hereinafter, the direction of the axis L2 will be referred to as an "axial direction". On a first end of the driven roller 23 along the axial direction, e.g., on a left-hand end of the driven roller 23, a first bearing 25A, which allows the driven roller 23 to rotate, is provided.

Figure 3:
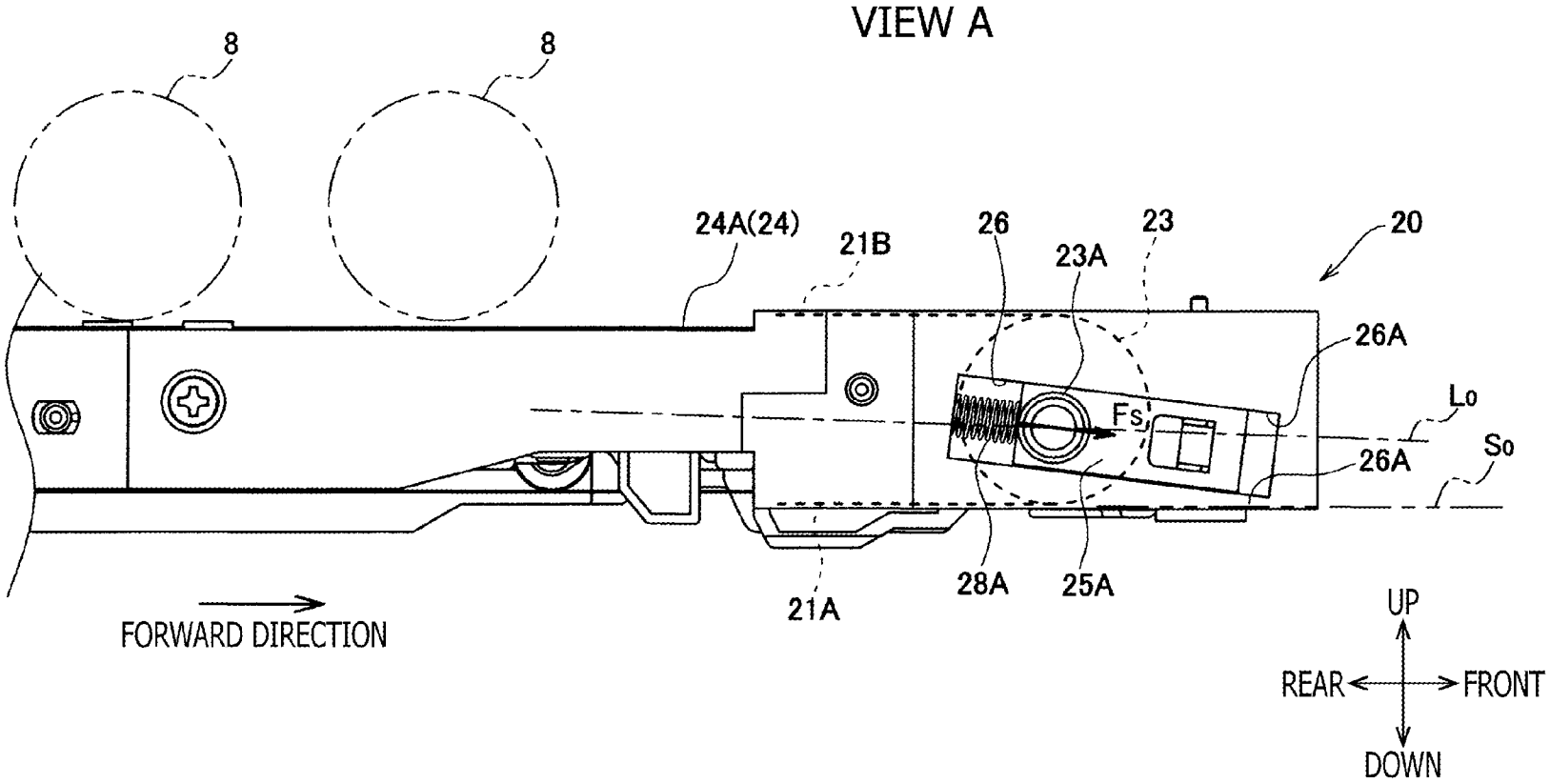
FIG. 3 is a side and partial view of the belt unit 20 of the image forming apparatus 1 according to the embodiment of the present invention taken along an arrow A shown in FIG. 2.

The first bearing 25A is a block, which supports a shaft 23A of the driven roller 23 rotatably (see also FIG. 3). The first bearing 25A is movable in a direction approximately in parallel with the longitudinal direction of the first frame 24A.

On a second end of the driven roller 23 along the axial direction, which is the opposite end from the first end along the axial direction, e.g., on a right-hand end of the driven roller 23, a second bearing 25B (see FIG. 4), which allows the driven roller 23 to rotate, is provided. The second bearing 25B is a block, which supports the shaft 25A of the driven roller 23 rotatably. The second bearing 25B is movable in a direction approximately in parallel with the longitudinal direction of the first frame 24B.

The longitudinal direction of the first frame 24A and the longitudinal direction of the second frame 24B are in parallel with the direction extending from the driving roller 22 toward the driven roller 23. While the driven roller 23 is movable in parallel with the longitudinal direction of the first frame 24A and the second frame 24B, the driven roller 23 is movable in the direction extending from the driving roller 22 toward the driven roller 2 to be separated from the driving roller 22.

On one of the longitudinal ends of the first frame 24A closer to the driven roller 23, as shown in FIG. 3, a first guide 26 being a rectangular-shaped opening is formed. The first bearing 25A is movably fitted in the first guide 26. The first bearing 25A is movable along a direction of longer sides of the rectangular-shaped first guide 26.

Thus, the first bearing 25A is guided by inner planes in the first guide 26, particularly by a pair of inner planes 26A, which spread in parallel with the longer sides and restrict the movable direction of the first bearing 25A. In this regard, the guiding direction of the first guide 26 to guide the first bearing 25A, which corresponds to the spreading direction of the inner planes 26A, inclines with respect to a virtual line L0. The virtual line L0 is a line extending through the rotation axis O1 of the driving roller 22 and the rotation axis O2 of the driven roller 23.

At the same time, the longer sides of the rectangular-shaped first guide 26, i.e., the guiding direction for the first guide 26 to guide the first bearing 25A, incline to be closer to a virtual plane S0 as the longer sides extend farther from the driving roller 22. In this regard, the virtual plane S0 is a plane including the strained plane 21A.

Figure 4:
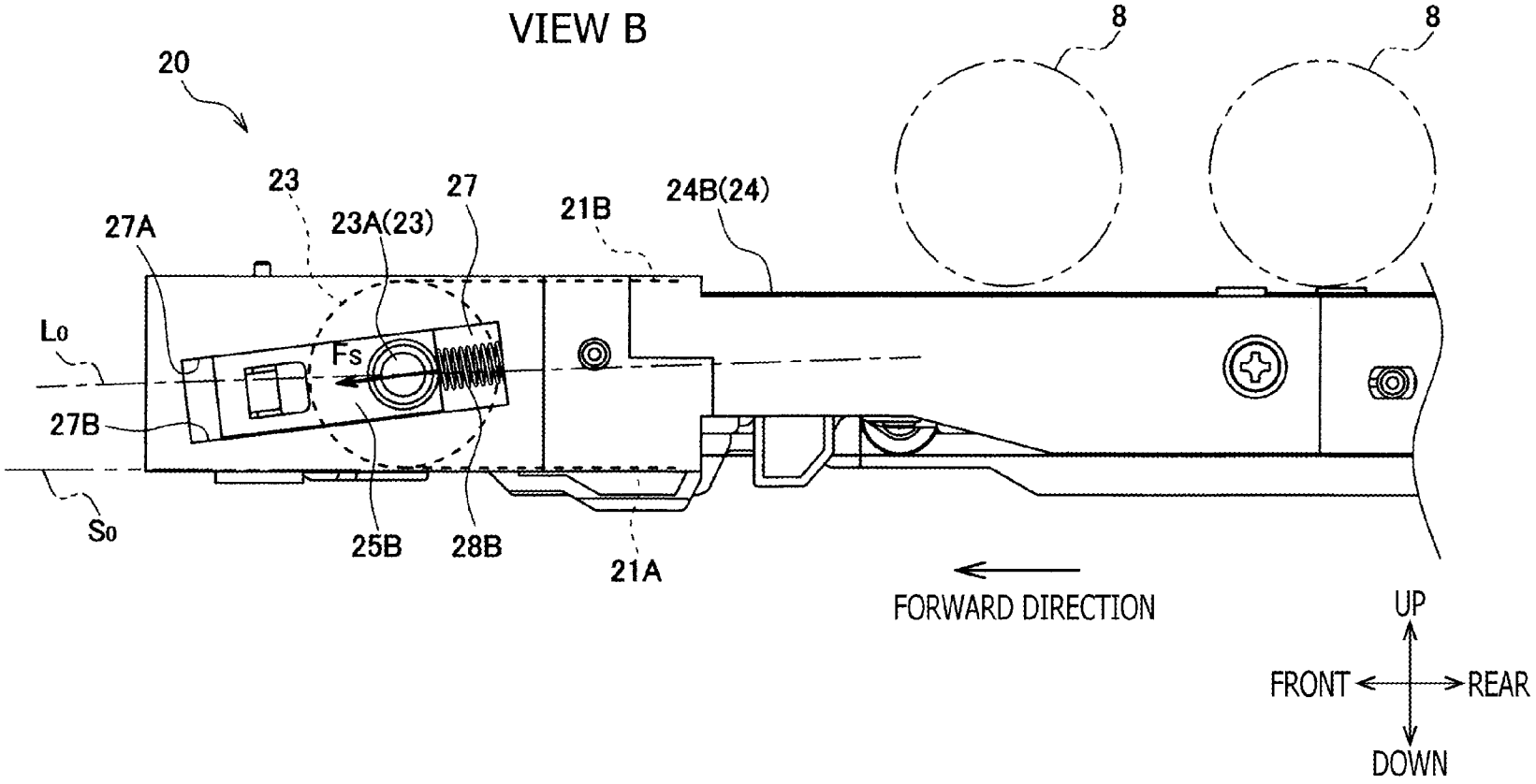
FIG. 4 is a side and partial view of the belt unit 20 of the image forming apparatus 1 according to the embodiment of the present invention taken along an arrow B shown in FIG. 2.

Meanwhile, as shown in FIG. 4, the second bearing 25B is placed in a structure similar to the first bearing 25A. Thus, the second bearing 25B is movably fitted in a rectangular-shaped second guide 27. The second bearing 25B is movable along a direction of longer sides of the rectangular-shaped second guide 27 and is guided by inner planes in the second guide 27, particularly by a pair of inner planes 27A, which spread in parallel with the longer sides and restrict the movable direction of the second bearing 25B.

In this regard, the longer sides of the rectangular-shaped second guide 27, i.e., the guiding direction for the second guide 27 to guide the second bearing 25B, incline to be closer to the virtual plane S0 as the longer sides extend farther from the driving roller 22.

In FIGS. 3 and 4, it may appear that the first guide 26 and the second guide 27 incline with respect to the virtual line L0 clearly; however, an angle of the inclination may not necessarily be as large as how it appears in the drawings. That is, for eyes of users, the virtual line L0 may appear to extend approximately in parallel with the virtual plane S0, and the first guide 26 and the second guide 27 may appear to extend approximately in parallel with the virtual plane S0.

As shown in FIG. 3, the first bearing 25A is subject to a resilient force Fs from a first spring 28A. The resilient force Fs tends to separate the driven roller 23 away from the driving roller 22, and the first spring 28A applies the resilient force Fs to the driven roller 23 via the first bearing 25A. Similarly, as shown in FIG. 4, the second bearing 25B is subject to a resilient force Fs, which tends to separate the driven roller 23 away from the driving roller 22, from the second spring 28B.

As shown in FIG. 5, a guide rib 21C is arranged on an inner circumferential surface of the belt 21 at a position corresponding to the second end, e.g., on the right-hand end, of the driving roller 22 and the driven roller 23 along the axial direction. The guide rib 21C extends along the rolling direction of the belt 21 and protrudes inward from the inner circumferential surface of the belt 21. The guide rib 21C is made of a resin such as urethane and is adhered to the belt 21 by, for example, an adhesive agent to be integrated with the belt 21.

Meanwhile, each of the driving roller 22 and the driven roller 23 is formed to have a groove 29, at a position corresponding to the second end, e.g., on the right-hand end, of the driving roller 22 and the driven roller 23 respectively along the axial direction. In the grooves 29, the guide rib 21C adhered to the belt 21 and protruding inward is inserted. Each of the grooves 29 has a first lateral wall 29A and a second lateral wall 29B.

The first lateral wall 29A and the second lateral wall 29B are formed in spaced-apart positions from each other along the axial direction to face each other. The guide rib 21C is inserted in a gap formed in between the first lateral wall 29A and the second lateral wall 29B.

3. Configuration of the Belt Unit and the Image Forming Apparatus

In the present embodiment, as shown in FIG. 3, the first guide 26 is formed to incline with respect to the virtual line L0 to be closer to the virtual plane S0 including the strained plane 21A as the first guide 26 extends farther from the driving roller 22.

When the first bearing 25A moves along the first guide 26, the axis L2 of the driven roller 23 inclines with respect to the axis of the driving roller 22, and the strained plane 21A may be distorted. In this regard, a skewing force, which may absorb an inherent skewing force being applied to the belt 21, can be generated. Thus, the belt 21 may be restrained from undesirable skewing.

The skewing force may include a first skewing force, which causes the belt 21 to skew in a direction from the first end, e.g., the left-hand end, toward the second end, e.g., the right-hand end, along the axial direction; and a second skewing force, which causes the belt 21 to skew in a direction from the second end toward the first end along the axial direction. However, it may be difficult to foresee which one of the skewing forces should occur inherently in the belt 21 during a product developing phase.

Meanwhile, the skewing force acquired by moving the first bearing 25A along the first guide 26 is the second skewing force. Therefore, when the first skewing force occurs as the inherent skewing force, the inherent skewing force can be reduced or absorbed by the second skewing force produced by moving the first bearing 25A along the first guide 26. On the other hand, when the second skewing force occurs as the inherent skewing force, the inherent skewing force may not be reduced or absorbed by moving the first bearing 25A along the first guide 26.

In this regard, according to the present embodiment, at least at the second (right-hand) end part of the inner circumferential surface of the belt 21 along the axial direction, the guide rib 21C protruding inward from the inner circumferential surface of the belt 21 is provided to extend along the circulating direction of the belt 21. The guide rib 21C is inserted in the grooves 29 formed at the first (right-hand) ends of the driving roller 22 and the driven roller 23 along the axial direction; therefore, the belt 21 is restricted from skewing toward the first (left-hand) end along the axial direction.

Accordingly, even when the inherent skewing force being the second skewing force occurs, with the guide rib 21 inserted in the groove 29, the belt 21 can be restricted from skewing. Thus, whether the first or the second skewing force occurs as the inherent skewing force, the belt 21 can be restricted from skewing.

According to the embodiment of the present invention, the second bearing 25B to support the second end of the driven roller 23 along the axial direction is guided in the second guide 27, which inclines at the same angle as the first guide 26.

Therefore, the skewing force produced by moving the second bearing 25B along the second guide 27 is the first skewing force. Therefore, when the second skewing force occurs as the inherent skewing force, the inherent skewing force can be reduced or absorbed by the first skewing force produced by moving the second bearing 25B along the second guide 27.

Thus, whether the first or the second skewing force occurs as the inherent skewing force, the belt 21 can be securely restricted from skewing.

According to the embodiment of the present invention, on the transferable plane 21B of the belt 21, which is the opposite side of the belt 21 from the strained plane 21A across the driving roller 22 and the driven roller 23, the photosensitive drums 8 are disposed. Further, on the transfer surface 21A, as shown in FIG. 1, the sheet is supplied from the side of the driven roller 23 and conveyed toward the driving roller 22.

Due to the movable structure of the first bearing 25A and the second bearing 25B attached to the driven roller 23, when at least one of the first bearing 25A and the second bearing 25B is moved with inclination along the first guide 26 or the second guide 27, a part of the transferable plane 21B of the belt 21 closer to the driven roller 23 is moved in a direction to be apart from the photosensitive drums 8 to a small extent. Therefore, when the sheet is supplied to the transferable plane 21B of the belt 21, the sheet may be inserted into the gap between the transferable plane 21B and the photosensitive drums 8 smoothly.

4. More Examples

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the first guide 26 and the second guide 27 may not necessarily incline at the same angle. For example, the second guide 27 may be formed to extend in parallel with the virtual line L0 while the first guide 26 is formed to incline with respect to the virtual line L0.

For another example, the belt 21 may not necessarily be provided with the guide rib 21C at the right-hand end along the axial direction. For example, the guide rib 21C may not be provided at all. In this regard, defects, which may otherwise be caused by abrasion of the guide rib 21C or by the guide rib 21C running off of the grooves 29, may be reduced theoretically to none. For another example, another guide rib may be arranged on the left-hand end of the belt 21C along the axial direction additionally to the guide rib 21C on the right-hand end. The additional guide rib may serve even more effectively to stabilize the belt 21 and restrict the belt 21 from skewing.

For another example, the present invention may not necessarily be applied to the direct-typed image forming apparatus, which transfers the developer agent from the photosensitive drums 8 directly to the sheet, but may be similarly applied to an intermediate transfer-typed image forming apparatus, which transfers the developer agent primarily to the belt 21 and transfers the primarily-transferred developer agent to the sheet secondarily.

For another example, in the embodiment described above, the belt 21 is rolled around the driving roller 22 and the driven roller 23 while the driven roller 23 serves to apply tensile force to the belt 21. However, the driven roller 23 may not necessarily serve to apply the tensile force to the belt 21, but another roller to adjust the tensile force in the belt 21 may be provided.

What is claimed is:

1. An image forming apparatus configured to form an image on a sheet, comprising:

a piece of endless belt;

a driving roller, around which the endless belt is strained, the driving roller being configured to move the endless belt in circulation;

a driven roller, around which the endless belt is strained, the driven roller being configured to rotate along with the circulation of the endless belt;

a first bearing arranged on a first-side end of the driven roller along an axial direction, the axial direction corresponding to a rotation axis of the driven roller, and configured to support the driven roller rotatably, the first bearing being configured to be movable while supporting the driven roller rotatably;

a resilient member configured to apply a resilient force, which tends to separate the driven roller apart from the driving roller, to the driven roller; and a frame comprising a first guide, the first guide being configured to guide the first bearing to move in an inclined direction, which inclines with respect to a virtual line extending through a rotation axis of the driving roller and the rotation axis of the driven roller, wherein a strained plane is formed by part of the endless belt moving directly from the driving roller to the driven roller and the first guide is formed to incline to be closer to the strained plane as the first guide extends farther from the driving roller.

2. The image forming apparatus according to claim 1, wherein a guide rib is arranged on an inner circumferential surface of the endless belt at least at a position corresponding to a second-side end along the axial direction, the guide rib being arranged to extend along a circulating direction of the endless belt and to protrude inward from the inner circumferential surface of the endless belt;

wherein each of the driving roller and the driven roller is formed to have a groove at the second-side end along the axial direction; and wherein the guide rib is inserted in the grooves formed in the driving roller and the driven roller.

3. The image forming apparatus according to claim 1, further comprising:

a second bearing arranged on a second-side end of the driven roller along the axial direction and configured to support the driven roller rotatably, the second bearing being configured to be movable while supporting the driven roller rotatably; and a second guide configured to guide the second bearing to move in a direction, which inclines at a same angle as the inclined direction of the first guide.

4. The image forming apparatus according to claim 3, wherein the resilient member comprises:

a first spring configured to apply the resilient force to the driven roller at the first-side end along the axial direction; and a second spring configured to apply the resilient force to the driven roller at the second-side end along the axial direction.

5. The image forming apparatus according to claim 1, further comprising:

wherein a photosensitive drum is arranged on an opposite plane of the endless belt which is opposite from the strained plane across the driving roller and the driven roller, the photosensitive drum being configured to carry an image, which is formed in a developer agent and is to be transferred to the sheet being conveyed on the opposite plane; and wherein the sheet is supplied to the opposite plane of the endless belt from a side of the driven roller toward a side of the driving roller.

6. The image forming apparatus according to claim 5, wherein at least a part of the opposite plane is moved to be farther from the photosensitive drum when the first guide extends farther from the driving roller.

7. The image forming apparatus according to claim 1, further comprising:

an image forming unit, wherein the first guide is formed to incline to be farther from the image forming unit as the first guide extends farther from the driving roller.

8. The image forming apparatus according to claim 1, further comprising:

a second bearing arranged on a second-side end of the driven roller along the axial direction and configured to support the driven roller rotatably, the second bearing being configured to be movable while supporting the driven roller rotatably; and a second guide configured to guide the second bearing to move in a direction, which extends in parallel with the virtual line.

9. The image forming apparatus according to claim 2, wherein a second guide rib is arranged on an inner circumferential surface of the endless belt at least at a position corresponding to the first-side end along the axial direction, the second guide rib being arranged to extend along a circulating direction of the endless belt and to protrude inward from the inner circumferential surface of the endless belt;

wherein each of the driving roller and the driven roller is formed to have a groove at the first-side end along the axial direction; and wherein the second guide rib is inserted in the grooves formed in the first-side ends of the driving roller and the driven roller.

* * * * *